United States Patent [19]

Halbeck

[11] 3,961,145

[45] June 1, 1976

[54] MINIATURE ELECTRONIC WATCH SWITCH

[75] Inventor: Werner B. Halbeck, Mequon, Wis.

[73] Assignee: Cutler-Hammer, Inc., Milwaukee, Wis.

[22] Filed: Dec. 12, 1974

[21] Appl. No.: 532,155

[52] U.S. Cl. ..... 200/155 A; 200/11 A; 58/23 R

[51] Int. Cl.[2] ..... H01H 19/58

[58] Field of Search ..... 200/155 R, 155 A, 11 R, 200/11 G, 11 DA, 11 A; 58/23 R, 50 R, 85

[56] References Cited

UNITED STATES PATENTS

| | | | |
|---|---|---|---|
| 2,980,770 | 4/1961 | Nabstedt | 200/11 A |
| 3,300,594 | 1/1967 | Paine et al. | 200/11 G |
| 3,699,279 | 10/1972 | Lockard et al. | 200/11 G |
| 3,736,390 | 5/1973 | Lockard | 200/11 DA |

*Primary Examiner*—Robert K. Schaefer
*Assistant Examiner*—M. Ginsburg
*Attorney, Agent, or Firm*—H. R. Rather; Wm. A. Autio

[57] ABSTRACT

An extremely small time-setting switch adapted for mounting in a hole in the case of an electronic watch and having a coin slot whereby it may be rotated to any one of a plurality of operating positions including a "run" position, a "stop" position, a "minutes change" position, and an "hours change" position. The switch is provided with a generally annular detent structure affording clearance at its middle for the movable contact and affording a better feel including an audible click when rotated into each of its several operating positions and the stationary parts of the switch are locked to one another to prevent movement when the rotary knob is turned in a structure affording an extremely thin, flat package adapted to be staked into the watch case.

10 Claims, 5 Drawing Figures

MINIATURE ELECTRONIC WATCH SWITCH

BACKGROUND OF THE INVENTION

Miniature time-setting switches have been known heretofore such as the switch disclosed in H. B. Halbeck, R. J. Patz and F. O. Sell copending application Ser. No. 455,923, filed Mar. 28, 1974, now U.S. Pat. No. 3,869,586 issued Mar. 4, 1975, and owned by the assignee hereof. However, these prior switches have had certain disadvantages such as the difficulty of properly orienting the parts and maintaining such orientation in assembly. Another disadvantage has been the difficulty of providing effective detent means in a thin switch this small. While these prior switches have been useful for their intended purpose, this invention relates to improvements thereon.

SUMMARY OF THE INVENTION

This invention relates to miniature electronic watch switches and more particularly to plural-position time-setting switches of the rotary type.

An object of the invention is to provide an improved miniature switch for an electronic watch.

A more specific object of the invention is to provide an improved miniature watch switch that is constructed for easy orientation of the parts and maintenance of such orientation in assembly.

Another specific object of the invention is to provide a miniature watch switch with improved detent means that provides better feel including an audible click.

Another specific object of the invention is to provide a miniature watch switch with improved detent means that is easy to assemble.

Another specific object of the invention is to provide a miniature rotary watch switch with improved detent means that provides clearance for the movable contact while affording an extremely thin, flat switch construction.

Other objects and advantages of the invention will hereinafter appear.

DESCRIPTION OF THE PREFERRED EMBODIMENT

Figure 1:
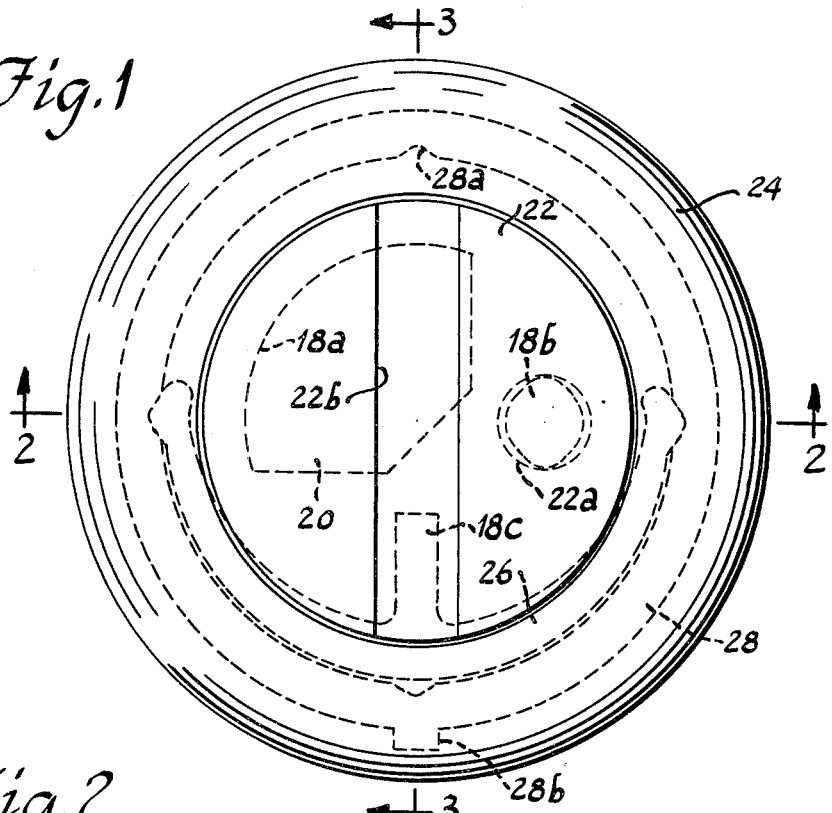
FIG. 1 is a greatly enlarged top view of a miniature watch switch showing some internal details including the movable contact, detent spring and detent ring, and locking lug.
Figure 2:
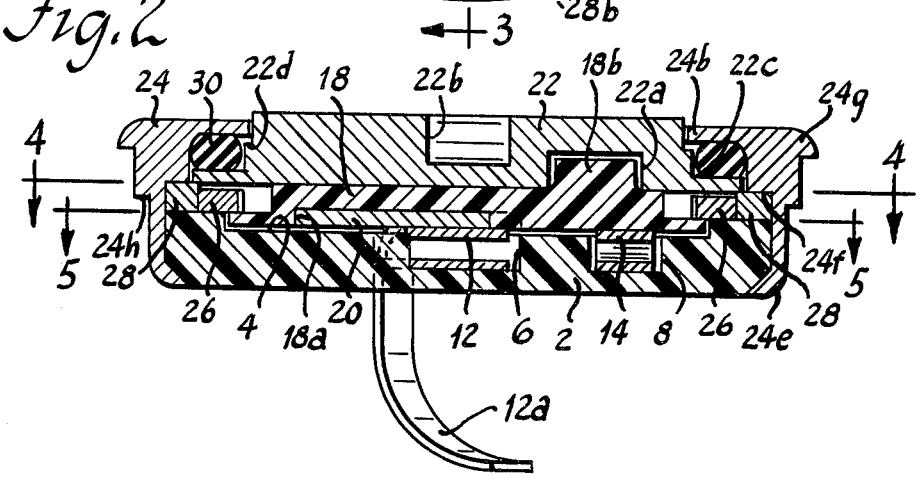
FIG. 2 is a cross-sectional view taken along line 2—2 of FIG. 1 to show internal details including the detent spring and detent ring.
Figure 3:
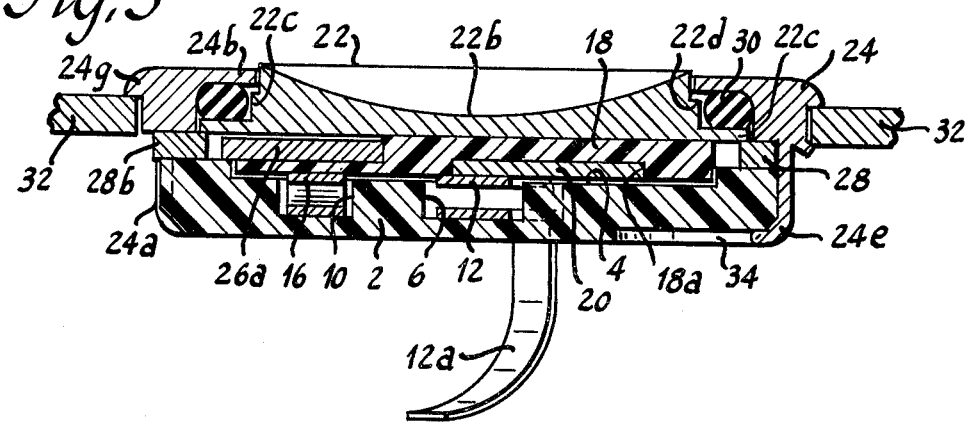
FIG. 3 is a cross-sectional view taken along line 3—3 of FIG. 1 to show internal details including the orienting lugs on the detent ring and base and the orienting slot in the frame.
Figure 4:
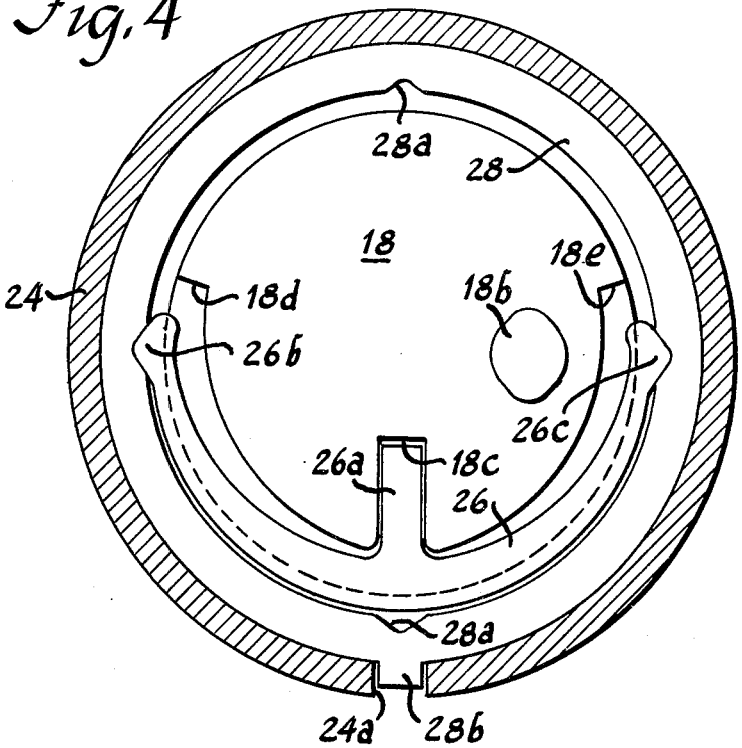
FIG. 4 is a cross-sectional view taken along line 4—4 of FIG. 2 to show the detent structure.
Figure 5:
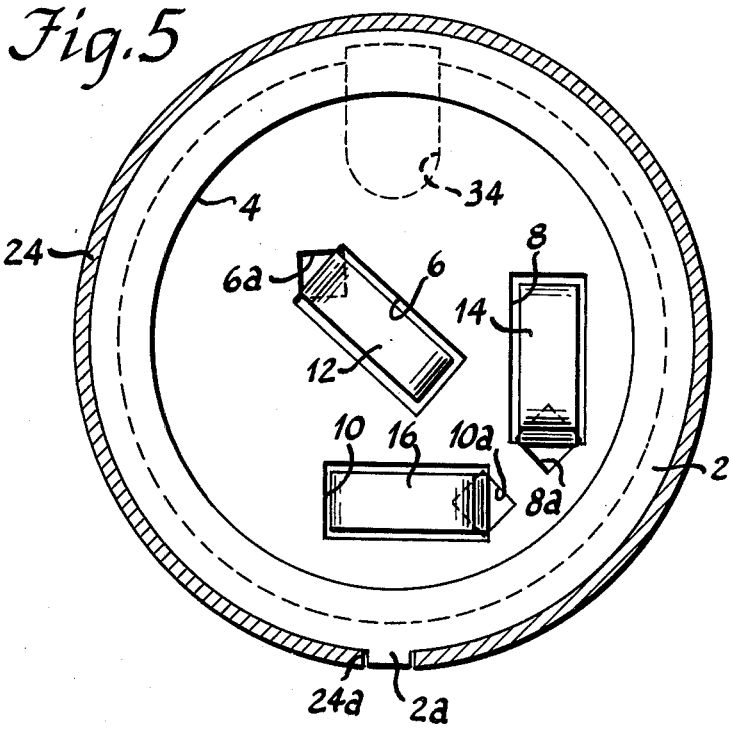
FIG. 5 is a cross-sectional view taken along line 5—5 of FIG. 2 to show the stationary contacts.

Referring to FIGS. 1–5, there is shown a miniature electronic watch switch constructed in accordance with the invention. This switch is provided with a generally thin circular insulating base 2 having a shallow circular cavity 4 in the upper surface thereof, and a plurality of shallow generally rectangular slots 6, 8 and 10 in the bottom of this cavity for retaining contacts 12, 14 and 16, respectively, as shown in FIG. 5. Slots 8 and 10 are angularly spaced alongside the periphery of cavity 4 and slot 6 is at the center of this cavity aligned with the space between slots 8 and 10. As shown in FIGS. 2, 3 and 5, each such slot has a generally shallow rectangular portion extending partway down into the base for retaining the associated contact (12 for example) and a square hole **6*a*, 8*a* and 10*a* at one end of such rectangular portion through which the integral terminal (12*a*** for example) of the associated contact extends in which an interference fit to project below the base for purposes hereinafter described.

Each such contact is made from a ribbon-like strip of BeCu or the like and has a 90° bend between its contact and terminal portions so that, whereas the terminal extends down through its square hole in the base and is formed to provide pressure engagement with connectors or a printed circuit board within the watch case, the contact extends horizontally along the shallow portion of its slot in the bottom of the base. This contact is bent back at about its midpoint through an angle of about 165° so that its upper contacting surface extends up at an angle of about 15 degrees from the floor level of cavity 4 in the base. This small upward angle provides inherent contact pressure when contact carrier 18 and movable contact 20 are clamped down thereon as hereinafter described. The tip of the upper bent-back contacting part is bent downwardly so that it will be not catch on the edge of the movable contact when knob 22 is rotated. While this bent-back contact portion is shown herein only in cross-section, it is similar to that shown in profile in FIG. 2 of the aforementioned copending application.

This contact carrier 18 is made of insulating material to electrically insulate movable bridging contact 20 from metal knob 22. As shown in FIGS. 1–4, this contact carrier is a generally thin circular disk having a shallow recess **18*a* on its lower surface, offset with respect to but overlapping its center as shown in FIG. 1, for retaining a first movable bridging contact 20**, this recess having a shape complementary to the shape of the movable contact, hereinafter described, to retain the latter therein. This shallow recess has a depth substantially equal to the thickness of the movable bridging contact so that the lower surface of the movable contact is substantially coplanar with the lower surface of the contact carrier to afford a smooth transition of each stationary contact from contact carrier to movable contact as the knob is turned.

This movable bridging contact 20 has the shape of a modified quarter-disk as shown in dotted lines in FIG. 1 with its right-angle corner cut off but affording some overlapping of the center axis of the switch wherein stationary contact 12 is positioned to enable the movable bridging contact to remain in engagement with "common" stationary contact 12 at all times.

As shown in FIGS. 2 and 3, contact carrier 18 is slightly smaller in overall diameter than shallow cavity 4 in the base so that it extends partway into this shallow cavity to be guided for rotation in the base when the parts are clamped together by frame 24 thereby to afford good contact pressure between the movable and stationary contacts. This contact carrier is also provided with an upstanding lug **18*b* molded integrally therewith and extending up into a cylindrical bore 22*a* that extends eccentrically partway up from the lower surface of the knob as shown in FIG. 2. This lug is partially complementary to its bore in the tangential direction to afford direct device from the knob to the contact carrier as shown in dotted lines in FIG. 1**, and is slightly thinner in its radial direction to afford free entry into its bore without the necessity of closetolerance manufacture. This lug and bore are offset from the switch center of rotation to provide leverage for driving the contact carrier when the knob is turned.

Detent means are provided for stopping the movable contact in each of its four operating positions with good "feel" including an audible "click" to ensure accurate positioning. This detent means is substantially annular in shape to provide clearance at the switch center where the movable contact is located to afford a thin switch structure. This means comprises a rotary detent spring 26 working against a stationary detent ring 28 as shown in FIG. 4. This detent ring is substantially a flat ring or washer-shaped member having substantial thickness laterally and four detent notches 28a spaced 90° apart (or an opposite pair for each switch position) on its inner edge and a lug **28*b* on its outer edge that locks the same into a slot 24*a* in the frame as shown in FIG. 4. Base 2 also has a lug 2*a* that locks in this same slot in the frame below the detent ring as shown in FIGS. 3 and 5.**

This detent spring 26 is an arcuate, substantially semi-circular member recessed in the upper peripheral surface of the contact carrier and extending through substantially 180° along the inner edge of the detent ring as shown in FIG. 4 and having an inwardly directed retention lug **26*a* at its midpoint that is substantially 90° from its opposite ends. This retention lug is retained in a complementary groove 18*c* in the upper surface of contact carrier 18. As shown in FIG. 4, this groove 18*c* extends from the periphery of the contact carrier along its upper surface partway toward its center but spaced from the shallow recess retaining the movable contact as shown in dotted line in FIG. 1.**

This groove **18*c* has a pair of branches 18*d* and 18*e* that extend in opposite directions along the upper surface periphery of the contact carrier to provide clearance for the opposite arms of the substantially semi-circular detent spring. These arms of the detent spring have substantial thickness laterally and are biased outwardly against the detent ring and are provided at their end portions with respective bumps 26*b* and 26*c*, 180° apart, that simultaneously enter opposite detent notches 28*a*** in the detent ring when the knob is turned.

The detent spring is made of high stress metal such as Type 17–7PH (PH meaning precipitation hardened) stainless steel, or the like, having a 265,000 psi tensile strength or stress and is subjected to about 240,000 psi stress in use. It is given the shape and form shown in FIGS. 2–4 having substantial thickness in the radial direction. These physical properties and bias afford the good detent "feel" and audible click whenever the switch is turned from one operating position to another.

The detent ring is made of ¾ hard 301 stainless steel that has a cold work hardenable characteristic. This results in initial wear and smoothing of detent surfaces while simultaneously providing work hardening and long detent life.

Knob 22 is made of stainless steel or the like that matches the watch case in which the switch is used. This knob is a generally thin disk having the aforesaid offset bore **22*a* in its lower surface. The upper surface of the knob is provided with an arcuate-depth dime slot 22*b* into which a coin of that denomination or other suitable tool may be inserted to provide a handle for rotating the knob. This knob is further provided with a radially-stepped, annular, peripheral portion to provide a rather wide, peripheral first step and riser 22*c* for retaining an O-ring seal 30 and a second, narrow step and riser 22*d* for receiving the circular, upper edge 24*b* of an angular-section annular metal frame or retainer 24** that surrounds the knob, O-ring and base.

As shown in FIGS. 2–3, the lower edge **24*e* of this frame is bent or formed over the bottom edge of the base which is beveled for this purpose. This bevel provides space for the formed-in edge of the frames so that it does not extend down below the bottom surface of the base. This lower edge of the frame is formed in while the parts are being clamped together to complete the assembly of the switch. Frame 24 has a step 24*f* on its inner surface as shown in FIG. 2 to provide an annular shoulder that rests on top of the detent ring. This limits the compression of the O-ring seal when the parts are clamped together and prevents upper edge 24*b*** of the frame from locking the knob while providing an effective seal against entry of water or the like.

The periphery of this frame is provided with a circular stepped surface terminating in a shoulder or rounded rim **24*g* forming a bezel up to which the switch can be pressed into a round hole in the watch case. The step 24*h* below rim 24*g* is wide enough so that a circular staking tool can be used to stake (cut into and form the metal over the watch case rim) the switch to the watch case 32 as shown at the right-hand side of FIG. 3 thereby to seal the switch to the case. A notch 34 shown in FIGS. 3 and 5** is provided in the bottom of the base as an aid in orienting the switch in the right direction when inserted into the watch case.

The switch is operated in 90° steps. In the position shown in FIGS. 1 and 5, the movable bridging contact engages only stationary contact 12 so that no switch closure is made. The pair of detent spring bumps are stopped in the two horizontally-aligned detent notches. This is the "run" position of the switch wherein the switch is running normally.

When the knob is turned 90° clockwise, the pair of detent spring bumps in the vertically-aligned detent notches and the movable contact bridges stationary contacts 12 and 14. This is the "hold" position of the switch wherein the watch is stopped awaiting restarting on a time tone or a "beep".

Another 90° clockwise turn of the knob causes the pair of detent spring bumps to stop in the horizontallyaligned detent notches and causes the movable contact to bridge all three stationary contacts. This is the "minutes-change" position of the switch wherein the minutes indication keeps advancing.

A third 90° turn of the knob clockwise causes the pair of detent spring bumps to stop in the vertically-aligned detent notches and causes the movable contact to bridge stationary contacts 12 and 16. This is the "hours change" position of the switch wherein the hours indication of the watch keeps advancing until the switch is turned to some other position.

Final clockwise rotation of the knob 90° returns the switch to the position shown in FIGS. 1 and 5. The switch can be turned in either the clockwise or counterclockwise direction as desired.

While the apparatus hereinbefore described is effectively adapted to fulfill the objects stated, it is to be understood that the invention is not intended to be confined to the particular preferred embodiment of miniature electronic watch switch disclosed, inasmuch as it is susceptible of various modifications without departing from the scope of the appended claims.

I claim:

1. A miniature switch adapted to be mounted in a hole in an electric or electronic watch case comprising:

a thin insulating base;

a plurality of stationary contacts mounted in said base and having terminals extending outside said base;

a thin insulating contact carrier;

a flat movable contact carried in a recess in the lower surface of and movable with said contact carrier to selectively engage said stationary contacts in several operating positions;

a thin metal knob secured to said contact carrier for moving the latter;

a frame securely holding said base, said contact carrier and said knob together in assembled relation to afford actuation of said knob and said contact carrier and said movable contact therewith while said base and said stationary contacts remain immobile;

and detent means affording a good feel for stopping said switch in each of its operating position when said knob is actuated comprising:

a detent ring member clamped between said frame and the peripheral portion of said base;

a detent spring member having a pair of arms biased in opposite directions against said detent ring member;

means locking said detent spring member to said contact carrier for movement therewith;

and bumps on one of said members and notches on the other member defining said operating positions of the switch, said bumps entering said notches to provide a good feel enabling accurate stopping of the switch in any one of its operating positions when said knob is actuated.

2. The miniature switch defined in claim 1, wherein:

said frame is provided with a slot;

and said base and said detent ring member are each provided with a lug projecting into said slot to lock the same non-rotatably to said frame.

3. The miniature switch defined in claim 1, wherein said means locking said detent spring member to said contact carrier comprises:

a lug at the midpoint of said detent spring member projecting between said arms;

and a groove on the upper surface of said contact carrier engaging said lug whereby said contact carrier drives said detent spring member therewith, and said groove extending in opposite directions along the periphery of said contact carrier providing clearance for said pair of arms of said detent spring member.

4. The miniature switch defined in claim 1, wherein:

said detent spring member is composed of high tensile strength steel providing a good feel and audible click when said bumps enter said notches when said knob is actuated.

5. The miniature switch defined in claim 1, wherein said means locking said detent spring member to said contact carrier comprises:

means providing a recess for said detent spring member in the upper surface of said contact carrier in an area laterally spaced around the movable contact recess in the lower surface thereof to allow partial, vertical overlapping of said recesses with adequate clearance therebetween thereby to afford a thin contact carrier construction contributing to small size and compactness of the switch.

6. A miniature switch adapted to be mounted in a hole in an electric or electronic watch case comprising:

a generally flat insulating base having a cavity therein;

a plurality of contacts mounted in said base, each having a resilient stationary contact extending slightly above the bottom of said cavity and a terminal extending through said base for connection to a circuit;

a generally flat metal knob having a coin slot in its upper surface and an insulating contact carrier locked to its lower surface for rotation therewith;

a flat movable bridging contact recessed in and substantially coplanar with the lower surface of said contact carrier for rotation therewith to selectively engage said stationary contacts in several operating positions of the switch;

detent means including a detent ring member and a detent spring member, one of said members having bumps and the other member having notches defining said operating positions of said switch;

an O-ring seal resting on the peripheral portion of said knob;

a frame surrounding said knob, O-ring seal, detent ring member and base and having first means clamping said detent ring member to the peripheral portion of said base and second means pressing said O-ring seal against said peripheral portion of said knob to seal said knob to said frame while allowing rotation of said knob;

said detent spring member being arcuate with its opposite ends biased against the inner edge of said detent ring member for pressure engagement between said bumps and notches and having a midpoint locking lug;

and a groove in the upper surface of said contact carrier for accommodating said detent spring member including its locking lug to lock said detent spring member for rotation with said contact carrier.

7. A miniature, extremely thin switch adapted to be mounted in a hole in an electronic watch case comprising:

a thin insulating base having a plurality of resilient stationary contacts mounted thereon with respective terminals extending down through the bottom of the base;

a thin insulating contact carrier overlying said base and said stationary contacts therein;

means guiding said contact carrier for rotation on said base on a vertical axis;

a flat movable contact recessed in said contact carrier, overlapping said vertical axis and substantially coplanar with the lower surface thereof to afford smooth transition onto said stationary contacts when said contact carrier is rotated;

a thin rotatable actuator overlying said contact carrier and coupled thereto for rotating the same;

a frame secured around said base and guiding said actuator for rotation relative thereto;

and a generally annular detent means arranged to surround said contact carrier so as to leave the central portion thereof clear for said movable contact and comprising:

a detent ring coupled to said frame and having a plurality of angularly spaced detent notches on its inner edge including a pair of opposite notches for each operating position of the switch;

and a detent spring recessed in the peripheral upper surface of said contact carrier and having means keying it for rotation with said contact carrier, and a pair of arcuate arms extending at least half-way around said contact carrier, and bumps on the extremities of said arms biased against the inner edge of said detent ring for entry into the oppositely disposed detent notches therein in each operating position of said switch.

8. The miniature, extremely thin switch defined in claim 7, wherein;

said frame has a slot;

and said base and said detent ring each has a lug extending into said slot to fix the angular positions thereof relative to said frame.

9. The miniature, extremely thin switch defined in claim 7, wherein:

said keying means comprises a lug on said detent spring extending into a slot in said contact carrier for keying said detent spring to said contact carrier.

10. The miniature, extremely thin switch defined in claim 7, wherein:

said detent ring is composed of ¾ hard stainless steel having a cold work hardenable characteristic affording initial wear and smoothing of detent surfaces while simultaneously providing work hardening and long detent life.

* * * * *